US009737932B2

(12) United States Patent
Ferrer

(10) Patent No.: US 9,737,932 B2
(45) Date of Patent: Aug. 22, 2017

(54) METHOD OF MANUFACTURING A COMPONENT COVERED WITH AN ABRADABLE COATING

(71) Applicant: SNECMA, Paris (FR)

(72) Inventor: Laurent Ferrer, Moissy-Cramayel (FR)

(73) Assignee: SNECMA, Paris (FR)

( * ) Notice: Subject to any disclaimer, the term of this patent is extended or adjusted under 35 U.S.C. 154(b) by 333 days.

(21) Appl. No.: 14/432,994

(22) PCT Filed: Oct. 1, 2013

(86) PCT No.: PCT/FR2013/052326

§ 371 (c)(1),
(2) Date: Apr. 1, 2015

(87) PCT Pub. No.: WO2014/053761

PCT Pub. Date: Apr. 10, 2014

(65) Prior Publication Data

US 2015/0231699 A1 Aug. 20, 2015

(30) Foreign Application Priority Data

Oct. 5, 2012 (FR) ..... 12 59518

(51) Int. Cl.

| | |
|---|---|
| ***B22F 3/18*** | (2006.01) |
| ***B22F 3/14*** | (2006.01) |
| ***B22F 7/08*** | (2006.01) |

(52) U.S. Cl.

CPC ..... *B22F 3/18* (2013.01); *B22F 3/14* (2013.01); *B22F 7/08* (2013.01); *Y10T 156/10* (2015.01)

(58) Field of Classification Search

CPC ..... B22F 3/18; B22F 7/08; B22F 3/14; Y10T 156/10

See application file for complete search history.

(56) References Cited

U.S. PATENT DOCUMENTS 5,663,276 A * 9/1997 Yoneta ..... C08G 63/605 427/384

2004/0111892 A1 6/2004 Greene et al.

(Continued)

FOREIGN PATENT DOCUMENTS

CN 1896451 A 1/2007
CN 101801567 A 8/2010

(Continued)

OTHER PUBLICATIONS

English language translation of Second Office Action and Search Report issued Jan. 3, 2017, in corresponding Chinese Application No. 201380056773.5 (8 pages).

(Continued)

*Primary Examiner* — Anthony J Zimmer

(74) *Attorney, Agent, or Firm* — Bookoff McAndrews, PLLC

(57) ABSTRACT

A method of fabricating a part covered in an abradable coating (55), the method comprising the following steps: a blank (10) for the part, the blank having a housing (20) opening out into the surface (15) of the blank (10); filling the housing (20) with an abradable material in powder form; and hot rolling the blank (10) and the abradable material together so as to sinter the abradable material and cause it to adhere to the blank, in order to obtain an abradable coating (55).

11 Claims, 2 Drawing Sheets

(56) References Cited

U.S. PATENT DOCUMENTS

| | | | | |
|---|---|---|---|---|
| 2006/0068214 | A1 | 3/2006 | Gigliotti et al. | |
| 2007/0092394 | A1 | 4/2007 | Groh | |
| 2007/0258844 | A1* | 11/2007 | Crum | C21D 6/004 420/53 |
| 2011/0268566 | A1* | 11/2011 | Ferrer | B21C 37/154 415/200 |
| 2012/0114971 | A1 | 5/2012 | Andler et al. | |
| 2012/0174644 | A1* | 7/2012 | Chazal | B21D 37/12 72/165 |

FOREIGN PATENT DOCUMENTS

| | | | |
|---|---|---|---|
| EP | 1 779 946 | A1 | 5/2007 |
| EP | 2 112 326 | A1 | 10/2009 |
| FR | 2 935 623 | A1 | 3/2010 |
| GB | 2 315 778 | A | 2/1998 |
| JP | H03202433 | A | 9/1991 |

OTHER PUBLICATIONS

Search Report mailed on Jan. 17, 2014, in corresponding International Application No. PCT/FR2013/052326 filed on Oct. 1, 2013 (2 pages).

* cited by examiner

METHOD OF MANUFACTURING A COMPONENT COVERED WITH AN ABRADABLE COATING

This application is the U.S. national phase entry under 35 U.S.C. §371 of International Application No. PCT/FR2013/052326, filed on Oct. 1, 2013, which claims priority to French Patent Application No. FR 1259518, filed on Oct. 5, 2012, the entireties of each of which are incorporated by reference herein.

FIELD OF THE INVENTION

The present disclosure relates to a method of fabricating a part covered by an abradable coating.

STATE OF THE PRIOR ART

Numerous machines have portions that, when moving, rub against other portions or run the risk of rubbing against other portions. For example, certain machines comprise a movable part that rotates about an axis, with a portion of the movable part rubbing against another part. This applies to turbomachines (whether terrestrial or for aviation, such as turbojets or turboshaft engines) that have a rotor with movable blades that, in their rotary movement, rub against the inside face of a stator casing surrounding them.

In a turbomachine, it is common practice to leave a space or clearance between the stationary portions and the movable portions, in particular between the casing and the movable blades, in order firstly to accommodate geometrical tolerances of the parts and secondly to accommodate mechanisms whereby materials expand thermally and creep over time. It is important to minimize leaks of gas or air via this space. Such leaks diminish the flow rate of the air stream compressed through the turbomachine, giving rise to a loss of available mechanical work and consequently affecting the efficiency of the turbomachine, increasing its fuel consumption and decreasing the thrust it produces.

In order to minimize these leaks, the solution presently in use consists in bringing the movable blades as close as possible to the casing and in covering the casing with a coating of soft material facing the blades. This material is abradable, which means that it has the property of being easy for the tips of the movable blades to dig into in the event of contact. Thus, a blade is practically undamaged when it rubs against the abradable material and the space between the tip of the blade and the inside surface of the casing is optimized by adjusting this space to a minimum over time.

At present, strip portions of an abradable material are fabricated, each strip portion is then stuck to the casing in order to form a complete abradable strip. Such a method is lengthy and expensive. Furthermore, using adhesive presents numerous constraints: cleaning the surfaces that are to receive the adhesive, problems of contamination of the cleaned surfaces, poor adhesion, etc. Finally, the mechanical stresses generated during fabrication of the strip portions of abradable material and while they are being stuck into place lead during operation to these strip portions becoming unstuck from the surface of the casing and/or to cracking and to premature deterioration of the strips in service.

The present invention seeks to remedy these drawbacks, at least in part.

SUMMARY OF THE INVENTION

The present description provides a method of fabricating a part covered in an abradable coating, the method comprising the following steps:

A) providing a blank for the part, the blank having a housing opening out into the surface of the blank;

B) filling said housing with an abradable material in powder form; and

C) hot-rolling the blank and the abradable material together so as to sinter and compact the abradable material and thereby cause it to adhere to the blank by diffusion welding, in order to obtain an abradable coating.

The blank that is provided is advantageously rough, i.e. the blank has not yet been shaped while hot (forging, rolling, . . . ). The housing may already have been shaped while hot and/or machined.

The rolling that is performed serves to apply hot compression locally to the abradable material. Typically, this is unidirectional hot compression acting normally to the inside surface of the blank. This hot compression serves to sinter and compact the abradable material and causes it to adhere to the blank by diffusion welding. Advantageously, the hot compression applied by the rolling suffices to sinter and compact the abradable material and to cause it to adhere to the blank, and the fabrication method does not have any hot compression step before or after the rolling step.

Such a method makes it possible to ensure that the particles of the abradable material are well compacted and that they cohere together well. Furthermore, with the temperatures and the pressures involved during rolling, the particles adhere well to the blank and the welding interface between the material of the blank presents few or no pores. The risk of the abradable coating subsequently becoming unstuck is thus reduced.

During rolling, the blank and the abradable material may be shaped as close as possible to the dimensions of the final part, e.g. using mandrels that are straight or mandrels that are shaped.

Furthermore, since the rolling operation takes place while hot, recrystallization mechanisms may take place, thereby reducing stresses in the abradable coating. Risks of the coating cracking, deteriorating, or becoming unstuck are likewise reduced.

The housing opens out into the surface of the blank via one or more openings. During rolling, pressure is exerted on the abradable material through the opening(s). In certain implementations, said housing is filled with the abradable material via the opening(s) during the filling step (step B) and the opening(s) is/are closed hermetically with a sheath, prior to the rolling step (step C).

In certain implementations, the method includes the following steps:

D) the opening via which the housing opens out into the surface of the blank is covered, with a sheath that presents at least one vacuum orifice and at least one filling orifice;

E) a vacuum is established inside said housing by using said vacuum orifice, and said housing is filled with the abradable material (in powder form) by using said filling orifice; and F) said vacuum orifice and said filling orifice are closed in leaktight manner before the rolling (step C).

It should be observed that steps D to F are performed after above-mentioned step A and before above-mentioned step B, with step E relating to step B.

In certain implementations, the rolling step C comprises a preheating first step C1 during which the blank is heated to a rolling temperature T, with the sintering of the abradable material taking place, at least in part, during this first step, and a second step C2 during which the blank and the abradable material are rolled together at the rolling temperature T. These steps lead to the abradable material being compacted.

Thus, the particles of abradable material become mutually agglomerated by sintering with given porosity, and this takes place while the blank is being preheated to the rolling temperature. Thereafter, during the rolling operation proper, the abradable material deforms as a result of the pressure exerted while hot (i.e. at the rolling temperature T). Thus, all of the empty cavities in the housing become filled with abradable material, the dilution zones (associated with the diffusion welding between the powder particles) increase, and the residual pores after sintering and compacting decrease, or even disappear. Recrystallization mechanisms in the abradable material may even be triggered, thereby further improving the uniformity of the abradable coating.

The rolling temperature (and more generally the thermo-mechanical cycle of the part) should be defined as a function of the narrowest forgeability range taking into account the adiabatic heating and the range that leads to the desired microstructures for the materials under consideration. In particular, for forgeability, the maximum temperature should be at the overheating or burning limit for one of the materials being shaped and the minimum temperature should be at the limit of microstructural damage to one of the materials. By way of example, if the reference material is a steel, the rolling temperature T may lie in the range 600° C. to 1350° C. For a steel known as EN X12CrNiMoV12 or for a steel known as EN X4NiCoNb38, the rolling temperature T may lie in the range 750° C. to 1300° C. For a steel known as Maraging250 EN X2NiCoMo18-8, the rolling temperature T may lie in the range 850° C. to 1250° C. If the material is a titanium alloy, the rolling temperature T may lie in the range 700° C. to 1150° C. For titanium alloys known as TA6V having a controlled alpha+beta structure, the rolling temperature T may lie in the range 700° C. to 1050° C., and it is advantageous to use a temperature T of about 950° C. For titanium alloys known as TA6V with a controlled beta structure, the rolling temperature T may lie in the range 1050° C. to 1150° C., and a temperature T of about 1100° C. is used advantageously.

In certain implementations, during the step of filling the housing (i.e. above-mentioned steps B or E), the abradable material is deposited as a plurality of layers of different kinds.

This makes it possible to vary the properties of the abradable material at different levels, given that requirements at the bottom of the housing are not the same as at the outside surface where the abradable material interacts with moving parts.

In certain implementations, during the step of filling the housing (i.e. above-mentioned steps B or E), the abradable material in its powder form comprises base particles that, after rolling (step C), constitutes the matrix of the abradable coating, together with secondary particles that facilitate fragmentation of the abradable coating.

The secondary particles facilitate fragmentation of the abradable coating when rubbing against a moving part, and thus serve to adjust the clearance between the moving part and the coating.

Advantageously, organic secondary particles may be introduced in the particle mixture. Such particles decompose during the rolling operation so as to form gas-filled pores. These pores facilitate fragmentation of the coating.

In certain implementations, the abradable material also comprises hard, wear-inducing particles that serve in operation to polish the moving parts, to some extent.

In certain implementations, the housing presents side faces that are concave (towards the inside of the housing). This serves to hold the abradable coating captive without generating residual stresses therein or at least to distribute the stresses at the interface between the abradable coating and the substrate, thereby limiting separation.

In certain implementations, the housing is a groove defined by an inside wall, two side walls surrounding the bottom wall, and two outer lips situated extending the side walls towards the center of the groove in such a manner that the groove presents a generally C-shaped profile in cross-section. Such a housing serves to hold the abradable coating firmly captive, in particular because of the outer lips that cover the coating in part and that retain it.

Naturally, it is possible to use housings of other shapes, with the compression during rolling serving to fill the entire housing, even if it is of a complex shape. In addition, during rolling, the housing may be deformed so as to hold the abradable coating captive even better.

In certain implementations, the blank is formed by hot rolling at least two sub-portions together, this rolling together of the sub-portions and the step of rolling the blank and the abradable material together (above-mentioned step C) being performed simultaneously as a single operation.

This makes it possible for fabrication tooling to perform more than one function and for a single rolling operation to be used both to fabricate the blank and to deposit the abradable coating. This saves time and money compared with conventional fabrication methods.

In certain implementations, after rolling step C, the blank and/or the coating of abradable material is/are machined in order to obtain the final part.

In certain implementations, after rolling step C, quality heat treatment is applied to the part as a whole, i.e. heat treatment for imparting to the part characteristics that it needs in use.

In certain implementations, the fabricated part is a turbomachine casing having a radially inner face, at least a portion of this face being covered by the abradable coating. In other words, said housing is provided in the radially inner face of the casing.

The invention can be well understood and its advantages appear better on reading the following detailed description of implementations. The detailed description refers to the accompanying drawings.

BRIEF DESCRIPTION OF THE DRAWINGS

The accompanying drawings are diagrammatic and not to scale, since they seek above all to illustrate the principles of the invention.

In the drawings, from one figure to another, elements (or portions of an element) that are identical or that are analogous in function are identified by the same reference signs.

DETAILED DESCRIPTION OF IMPLEMENTATIONS

Implementations are described in detail below with reference to the accompanying drawings. These implementations show the characteristics and advantages of the invention. It should nevertheless be recalled that the invention is not limited to these implementations.

Figure 1:
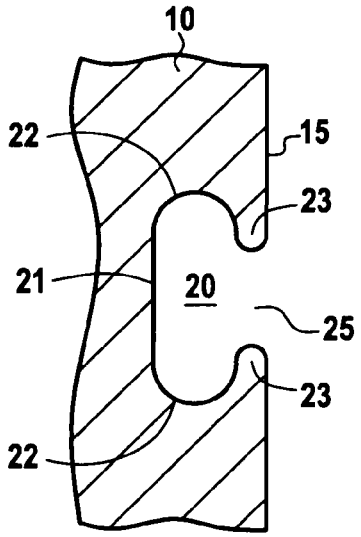
FIG. 1 is a cross-section showing a blank for a part, which blank includes a housing opening out into the surface of the blank.
Figure 2:
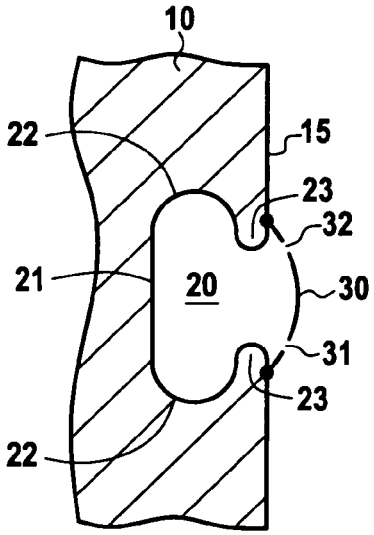
FIG. 2 shows the FIG. 1 blank, with a sheath put into place thereon.
Figure 3:
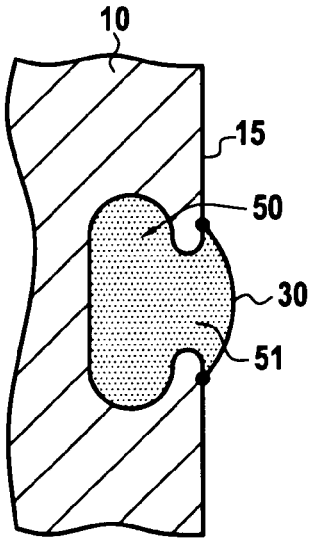
FIG. 3 shows a step of filling the housing with an abradable material in powder form.
Figure 4:
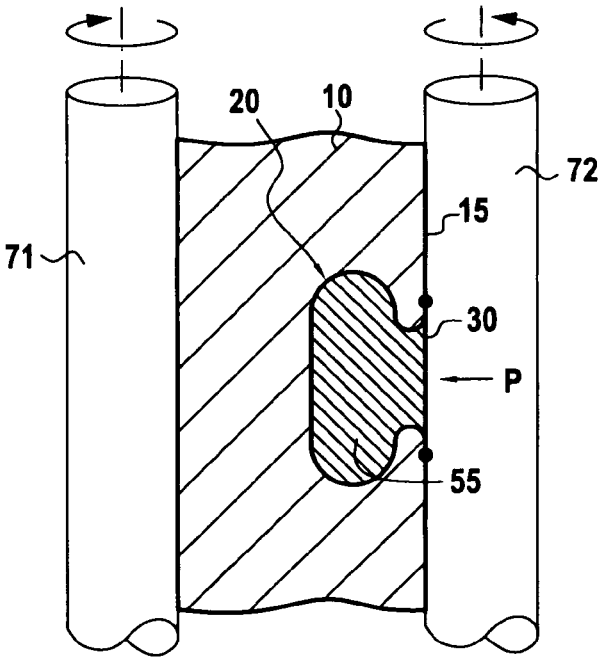
FIG. 4 shows a step of rolling of the blank and the abradable material together.
Figure 5:
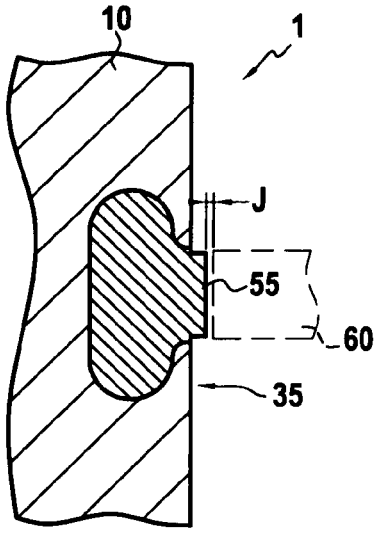
FIG. 5 shows a machining step.

FIGS. 1 to 5 show various steps in an implementation of the method of fabricating a part 1 with an abradable coating 50. The part 1 is shown in FIG. 5. A portion of the abradable coating 50 forms a layer 55 at the surface of the part 1. In this implementation, the layer 55 slightly projects outwards from the remainder of the part 1.

In this implementation, the part 1 is a turbomachine casing, e.g. a turbojet compressor casing. The casing has an abradable coating 55 against which movable parts 60 rub (see FIG. 5). These movable parts 60 are blades. The free surface 35 on which the abradable coating 55 is formed is the radially inner face of the casing. It is a surface of generally cylindrical shape, centered on the axis of rotation of the turbomachine rotor.

Naturally, the invention may be applied to parts other than a turbomachine casing.

In order to fabricate the part 1, a blank 10 is initially provided for the part. The blank 10, shown in FIG. 1, has a housing 20. The housing 20 opens out into the surface 15 of the blank 10 via an opening 25. This opening 25 is continuous. It could equally well be discontinuous, i.e. it could be made up of a plurality of sub-openings.

In this implementation, the housing 20 is a groove that extends in a direction perpendicular to the section plane of the figures. The shape of the housing 20 is preferably selected in such a manner as to hold captive the abradable coating 50 that is described below.

Advantageously, the maximum section of the housing 20 in a plane parallel to the surface 15 is situated at a non-zero distance from that surface. Thus, on approaching the opening 25, the housing 20 presents at least one converging portion. As a result, the abradable material 50 that fills the housing 20 (see below), once it is in the form of a single-piece block, is held mechanically in the housing 20.

In this implementation, the housing 20 is a groove defined by a bottom wall 21, two side walls 22 surrounding the bottom wall, and two outer lips 23 extending the side walls and projecting towards the center of the groove. The groove thus presents, in cross-section, a profile that is generally C-shaped. The opening 25 is defined between the outer lips 23. In cross-section, the side surfaces of the groove, as defined by the side walls 22, are concave towards the inside of the groove. Naturally, it is possible to use other shapes of housing 20.

By way of example, the housing 20 is made by machining in the blank 10. Prior to machining, the blank 10 may already have an indentation at the location where the housing 20 is to be machined. This indentation may be made when shaping the blank 10.

After it has been made, the housing 20 is cleaned.

Thereafter, the opening 25 of the housing 20 is covered with a sheath 30 that comprises vacuum orifices 31 and filling orifices 32. The sheath 30 is fastened to the entire periphery of the opening 25 on the edges of the lips 23 of the housing. By way of example, this fastening may be performed by welding. The size of the sheath 30 and the positions of the welds may be optimized to avoid any leakage.

The sheath 30 is made of a material that is sufficiently flexible and ductile and of thickness that is sufficiently small to deform under the effect of the pressure P that is applied during rolling (see below). The sheath 30 closes the opening 25 in leaktight manner with the exception of the orifices 31 and 32.

A vacuum is then established inside the housing 20 (i.e. in the closed space defined by the housing 20 and the sheath 30), while the housing 20 is being filled with an abradable material 50 in powder form. The fact that the abradable material 50 is in the form of a collection of separate particles makes such filling possible.

The abradable material 50 is constituted by a collection of particles. The term "particle" is used to mean an element of small size that may in particular be in the form of a substantially spherical grain or in a shape that is longer in one dimension (of the fiber type), or in two dimensions (of the plate type). All or most of the particles are made of a material that is sinterable, i.e. a material suitable for diffusing from one particle to an adjacent particle when the particles are compacted at high temperature, so that bonds are created between the particles: the material is then sintered. During sintering, the material constituting the particles does not necessarily melt. In a sintered material, it is possible for pores to remain. If the material is compacted at even higher temperatures, then the particles are deformed, and then diffusion welded, and as a result empty pores progressively disappear.

The abradable material 50 in its powder form may be constituted by a base powder 51. It may be a single powder or it may be a mixture of powders. After rolling, the base powder 51 constitutes the matrix of the abradable coating 55.

In this implementation and by way of example, the abradable material 50 is constituted by a mixture based on metal powders such as powders of a special alloy based on Ni or based on Fe. The abradable material is selected as a function of the required properties, in particular thermal properties.

Figure 6:
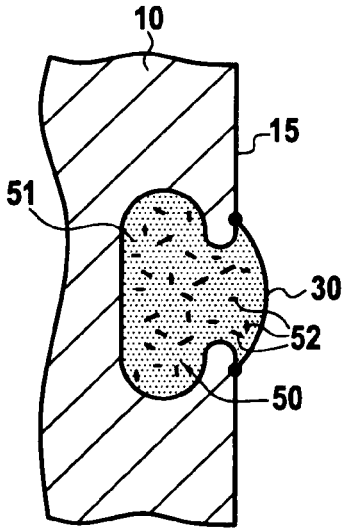
FIG. 6 is a figure analogous to FIG. 3, showing a step of filling the housing with another abradable material.

In another implementation that is shown in FIG. 6, in addition to the base powder 51, the abradable material 50 is constituted by secondary particles 52 that are mixed with the base powder, thereby facilitating fragmentation of the abradable coating 55 in operation. These secondary particles 52 may be particles that are organic, inorganic, metallic, intermetallic, etc., whose chemical interaction with the base of the abradable material is weak. For example, as secondary particles 52, it is possible to use oxides, in particular based on carbon, such as for example powders of pure carbon, carbon fibers, or carbides (SiC, TiC, WC, etc.), particles based on boron such as for example borides or borates ($TiB_2$, $SiB_2$, Laves phases, etc.), nitrides, and/or microbeads of an organic resin having a vaporization point slightly lower than the rolling temperature. These secondary particles 52 facilitate separation of pieces of abradable coating 55 when the movable part 60 with which the part 1 interacts moves past. The secondary particles 52 may have two modes of action. Either the particles 52 resist rolling and remain in solid form in the matrix of the abradable coating 55, thereby creating irregularities that weaken the structure of the matrix. For this purpose, it is possible to use particles that are inorganic, metallic, or intermetallic, e.g. oxides, carbon-based particles, boron-based particles, and/or nitrides. Otherwise, the secondary particles 52 are hollow and/or decompose, thereby releasing gas during rolling, thus creating pores that weaken the structure of the matrix. For this purpose, it is possible to use microbeads that are metallic and/or made of organic resin, having a vaporization point that is slightly lower than the rolling temperature. By way of example, the microbeads may be hollow resin beads or hollow metal beads, containing a vacuum or gas, or hollow metal beads having resin inside.

The secondary particles 52 may also be "wear-inducing", i.e. they may be selected for their properties of resistance to wear. In operation, such particles then serve to slightly polish the moving parts. For this purpose, it is possible to use particles that are inorganic, metallic, or intermetallic, and for example oxides, carbon-based particles (e.g. carbon powder, carbon fibers, carbides), particles based on boron (e.g. borides or borates), and/or nitrides.

Figure 7:
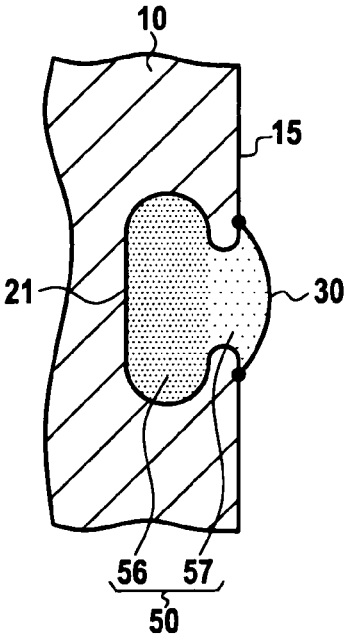
FIG. 7 is a figure analogous to FIG. 3, showing a step of filling the housing with an abradable material that is deposited as a plurality of layers.

In another implementation shown in FIG. 7, the abradable material (in powder form) is deposited as a plurality of layers 56, 57, these layers being of different kinds. Two layers are said to be of different kinds when the two layers are made of different materials, or when one layer is constituted by a mixture of materials and another layer is constituted by a mixture of the same materials, but in different proportions.

In other words, the housing 20 is filled by a stack of layers 56, 57, each layer having a specific composition. The composition of each layer depends on the functions desired for the layer. In the implementation of FIG. 7, the first layer 56, i.e. the layer that is closest to the bottom 21 of the housing 20, is constituted by way of example by an alloy having high capacity for diffusion welding and great tenacity in contact with the substrate, so as to accommodate a maximum amount of stress at the interface with the substrate. Otherwise, the second layer 57, i.e. the larger that is to come into contact with the moving part 60, is constituted by way of example by an alloy having high refractory content, and possibly high secondary particle content, so as to enhance the adaptability and the thermal stability of the surface over time. For example, if the casing material is a steel known as EN X12CrNiMoV12, depositing a first layer 56 of powder based on Fe serves to obtain better diffusion welding of the particles of powder on the substrate. This welding improves the strength of the abradable material. In addition, the fact of adding a final layer 57 based on Ni powders provides the surface of the abradable coating with greater ability to withstand high temperatures.

Naturally, more than two layers could be deposited. In order to deposit layers of different compositions in succession, various methods are possible. For example, a first method consists in modifying the mixture of particles being deposited progressively as the housing fills (filling may be optimized with the number of filling orifices) prior to establishing a vacuum. A second method consists in filling the underlayers one by one by depositing an intermediate sheet (e.g. a metal sheet) between two underlayers, and in finishing by depositing the sheath 30 before establishing the vacuum. A third method consists in spraying the abradable material 50 while hot or cold into the housing 20 via the opening 25 in order to obtain mechanical cohesion in successive layers prior to welding the sheath 30 and establishing the vacuum.

Once the housing 20 is completely filled with abradable material 50, the vacuum orifice 31 and the filling orifice 32 are closed so that the housing 20 is closed in leaktight manner. FIG. 3 shows this step.

The volume defined by the wall of the housing 20 and by the sheath 30, referred to as the initial volume, is strictly greater than the volume of the housing 20, where the volume of the housing 20 is defined by the wall of the housing 20 and a plane extending the surface 15 into which the opening 25 opens out.

Thereafter the blank 10 and the abradable material 50 are rolled together so as to sinter and compact the abradable material and so as to cause it to adhere to the blank, in order to obtain an abradable coating 55. Rolling serves to apply a pressure P that is higher than atmospheric pressure to the outside face of the sheath 30. The sheath 30 thus deforms under the effect of stress (unidirectional stress acting normally to the surface 15 in this implementation). This stress subjects the abradable material 50 to a compression in the housing 20 (the abradable material 50 also being stressed by the walls of the housing 20), the abradable material 50 also being subjected to a temperature T, which is generally higher than 150° C., so that sintering takes place between the particles of the abradable material 50 and this material becomes compacted in the housing 20. FIG. 4 shows this step.

In order to perform hot rolling, it is possible to use a hot ring rolling technique, or the like. An example of the hot ring rolling technique is described in the publication entitled "A summary of ring rolling technology. I—Recent trends in machines, processes, and production lines" bit. Mach. Tools 14 Manufact. Vol. 32, No. 3, 1992, pp. 379-398, by the authors E. Eruc and R. Shivpuri. In particular, it is possible to use two rotary mandrels that compress the blank 10 and the abradable material 50, one of the mandrels following the surface of the blank in which the opening 25 of the housing 20 is rotated so as to exert pressure on the abradable material 50 through the opening 25. In the example of FIG. 4, two rotary mandrels (of vertical axes in FIGS. 4) 71 and 72 compress the blank 10 and the coating 50 and reduce the thickness of the blank 10 by increasing its diameter. One of the mandrels 72 is in contact with the surface 15 and with the sheath 30 and exerts a pressure P thereon. Two cones (not shown and having axes that are horizontal in the figure) may be used for limiting the increase in the height of the blank 10 that can result from the action of the mandrels 71, 72. It is then possible to perform annealing heat treatment. This produces a circular part in the shape of a body of revolution having an abradable coating 55.

The rolling is performed hot at a temperature C higher than the temperature at which all of the pores in the abradable material 50 are resorbed. Typically, this temperature T lies in the range 700° C. to 1300° C. The sintering and the compacting of the abradable material 50, and thus its densification, begin during the heating during which the blank is maintained at the temperature T for a holding time, without pressure being applied. Compacting terminates during the rolling step proper. During rolling, the pressure P exerted by the roller 72 on the abradable material 50 through the opening 25 is a function of the flow stress specific to the abradable material at the rolling temperature. The flow stress of the abradable material is much less than that of the substrate, thereby enabling the layer of abradable material to be better deformed.

In this example, few or no pores remain within the abradable coating 55 after rolling. Consequently, the strength of the abradable coating 55 is increased.

In addition, inside the housing 20, adhesion between the particles of the abradable material 50 and the surface of the wall of the housing 20 is improved. The risk of the abradable coating 55 subsequently coming unstuck in operation is thus reduced.

After it has been rolled, the abradable material 50 is sintered and compacted and occupies a volume (referred to as its final volume) that is less than its initial volume, because of the compacting and the sintering that have taken place between the particles of the material.

Thereafter, temperature and pressure are reduced to ambient temperature and ambient pressure, respectively. The assembly is then machined in order to remove the sheath 30 and to give the part 1 its final shape, as shown in FIG. 5.

In this implementation, the surface 15 of the blank (in particular at its lips 23), and the side edges of the abradable coating 55 are machined in such a manner as to obtain a strip of abradable coating 55 that slightly projects from the remainder of the free surface 15 of the part 10. The movable part 60 rubs against this strip of abradable coating 55 in operation until the clearance between the coating 55 and the part 60 (drawn in dashed lines) is optimized, as shown in FIG. 5.

Figure 8:
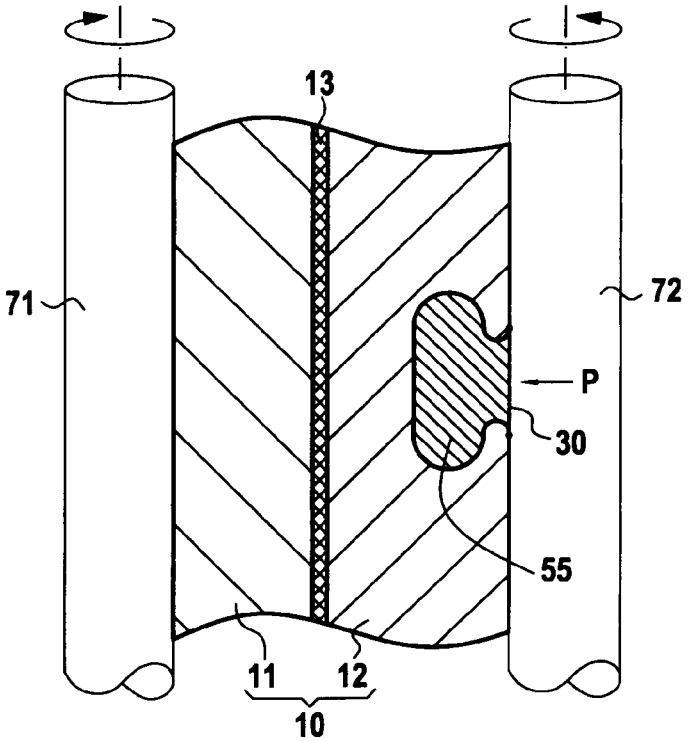
FIG. 8 is a figure analogous to FIG. 4, showing a rolling step.

In another implementation shown in FIG. 8, the blank 10 is made by hot rolling of at least two sub-portions 11 and 12 together.

By way of example, for a turbomachine casing, the first portion 11 may be made of titanium alloy while the second portion 12 is made of steel or of a nickel-based alloy. These two portions 11 and 12 may be separated by an anti-diffusion intermediate film 13. The first portion 11, which constitutes the load-bearing structure made of titanium alloy, is protected from risks of titanium fire by the second portion 12. The housing 20 that receives the abradable coating 55 is formed in the second portion 12.

In order to fabricate the blank 10, the portions 11, 12, and 13 are rolled together, and advantageously they are rolled together while simultaneously rolling together the portion 12 and the abradable coating 55, in a single common operation.

This reduces fabrication time and fabrication equipment is used for performing more than one function.

Finally, a quality heat treatment may be applied to the part 1.

The implementations described in the present description are given purely by way of non-limiting illustration and the person skilled in the art can easily, in the light of this description, modify these implementations or can envisage others while remaining within the scope of the invention.

Furthermore, the various characteristics of these implementations can be used singly or in combination with one another. When they are combined, these characteristics may be combined as described above or in other ways, the invention not being limited to the specific combinations described above. In particular, unless specified to the contrary, a characteristic that is described in association with one particular implementation may be applied in analogous manner with another implementation.

The invention claimed is:

1. A method of fabricating a part covered in an abradable coating, the method comprising the following steps:

providing a blank for the part, the blank having a housing opening out into the surface of the blank through at least one opening;

filling the housing with an abradable material in powder form; and hot-rolling the blank and the abradable material together so as to sinter the abradable material and cause it to adhere to the blank, in order to obtain an abradable coating, wherein, during the rolling step, pressure is exerted on the abradable material through the opening.

2. A fabrication method according to claim 1, wherein said housing is filled with the abradable material through the opening, and wherein the opening is closed hermetically with a sheath before the rolling step.

3. A fabrication method according to claim 1, wherein:

the opening is covered with a sheath that presents at least one vacuum orifice and at least one filling orifice;

a vacuum is established inside said housing by using said vacuum orifice, and said housing is filled with the abradable material by using said filling orifice; and said vacuum orifice and said filling orifice are closed in leaktight manner before the rolling step.

4. A fabrication method according to claim 1, wherein the rolling step comprises a preheating first step during which the blank is heated to a rolling temperature, with the sintering of the abradable material taking place, at least in part, during this first step, and a second step during which the blank and the abradable material are rolled together at the rolling temperature.

5. A fabrication method according to claim 1, wherein during the step of filling the housing, the abradable material is deposited as a plurality of layers of different kinds.

6. A fabrication method according to claim 1, wherein the abradable material in powder form comprises a base powder that, after sintering, constitutes the matrix of the abradable coating, together with secondary particles mixed with the base powder and facilitating fragmentation of the abradable coating.

7. A fabrication method according to claim 1, wherein said housing is a groove defined by a bottom wall, two side walls surrounding the bottom wall, and two outer lips situated extending the side walls towards the center of the groove in such a manner that the groove presents a generally C-shaped profile in cross-section.

8. A fabrication method according to claim 1, wherein the blank is formed by hot rolling together at least two sub-portions, and wherein the step of rolling together the sub-portions and the step of rolling together the blank and the abradable material are performed simultaneously as a single operation.

9. A fabrication method according to claim 1, wherein after the rolling step, the blank and/or the coating of abradable material is/are machined.

10. A fabrication method according to claim 1, wherein, during the rolling step, one of the rolling mandrels is in contact with the surface into which the housing opens out and exerts a pressure thereon.

11. A fabrication method according to claim 1, wherein the fabricated part is a turbomachine casing having a radially inner face, at least a portion of the radially inner face being covered by the abradable coating.

* * * * *